United States Patent [19]

Aldick et al.

[11] 4,127,480

[45] Nov. 28, 1978

[54] SETTLING MACHINE

[75] Inventors: Willi Aldick, Bochum; Alexander Lotz, Wetter, both of Germany

[73] Assignee: Damin Mineralien Gesellschaft mit beschränkter Haftung, Germany

[21] Appl. No.: 855,733

[22] Filed: Nov. 29, 1977

[30] Foreign Application Priority Data

Dec. 2, 1976 [DE] Fed. Rep. of Germany ..... 2654593

[51] Int. Cl.[2] ..... B03B 5/20

[52] U.S. Cl. ..... 209/457; 209/502

[58] Field of Search ..... 209/455–457, 209/425–427, 500–502

[56] References Cited

U.S. PATENT DOCUMENTS

| | | | |
|---|---|---|---|
| 1,926,375 | 9/1933 | Drinkwater | 209/457 X |
| 2,132,754 | 10/1938 | Nichols | 209/500 |
| 2,889,045 | 6/1959 | Turpin | 209/455 X |
| 3,842,978 | 10/1974 | Summers | 209/486 X |
| 4,019,981 | 4/1977 | Stern et al. | 209/457 X |

*Primary Examiner*—Frank W. Lutter
*Assistant Examiner*—Ralph J. Hill
*Attorney, Agent, or Firm*—McGlew and Tuttle

[57] ABSTRACT

A settling machine for upgrading materials, particularly for upgrading coal, comprises at least one settling chamber filled with water and having a jig screen covering at least a part of the chamber arranged at the water level. The chamber is also connected laterally of the jig screen to a plurality of different pressure sources and the connections are such that pressures may be superimposed on the liquid of the chamber to cause a pulsation thereof for the separation of the material contained on the jig screen. With the method of the invention, the pressure is connected via control lines having control valves which may be adjusted to get a number of settling strokes per minute by pressure surges which may be set to the range of between 20 to 50 settling strokes per minute for one of the control valves, and for the other control valve, may be arranged between 150 and 250 settling strokes per minute.

8 Claims, 3 Drawing Figures

SETTLING MACHINE

FIELD AND BACKGROUND OF THE INVENTION

This invention relates in general to material settling devices and, in particular, to a new and useful settling machine and method for upgrading coal or similar minerals, comprising one or more settling chambers filled with water, and including a jig screen for the material to be upgraded, and one or more air chambers which extend laterally of and below the jig screen and the water surface level and which can be pressurized with compressed air in a pulsatory manner, and which are connected to an air tank through air conduits with air inlet connections and air outlet connections and through interposed control valves.

DESCRIPTION OF THE PRIOR ART

Settling machines are known which provide for the stratifying of a granular mixture according to density, by lifting motions of water pulsating predominantly in a direction perpendicular to a jig screen. During the coal upgrading operation, the specifically heavier refuse material accumulates in a lower layer and the specifically lighter coal in an upper layer. The light coal actually follows the upwardly directed water pulses faster than the heavy waste. Consequently, the coal is driven farther upwardly. During the downward movement of the water, the coal and waste exhibit unequal dropping speeds. The waste drops faster than the coal and, consequently, accumulates at lower levels.

However, such a sorting process is effective only up to a certain grain size of coal and waste, that is, as follows from the influence factors mentioned above, during the settling process, the separation of coal and waste according to density and the separation due to equal settling may overlap. By equal settling, the phenomenon is understood that bodies having unequal geometrical dimensions and unequal specific weights, while dropping in a medium, attain the same final dropping speed. In the coal upgrading operation, an equal settling is undesirable, because what is wanted is the separation of coal from the refuse material. In general, however, equal settling occurs as soon as the grain size of the material to be settled drops from about 0.5 mm to 0.00 mm since then the waste floats on the jig screen along with the coal in conventional settling machines. The invention provides remedial measures in this respect.

SUMMARY OF THE INVENTION

The present invention is directed to a settling machine of the aforementioned type which ensures satisfactory upgrading of coal or similar minerals, even when the grain size of the material to be settled is less than 0.5 mm, and which is comprises a relatively simple and operationally suitable design.

To this end, in accordance with the invention, it is provided that each air conduit has at least two air inlet connections, each of which is associated with its own control valve, and that the second control valve controls a superimposed settling stroke.

Surprisingly, it has been found that an equal settling of the material is eliminated even with grain sizes of 0.5 mm or less if simultaneous or phase-displaced settling strokes are superimposed to the conventional settling strokes of a settling machine. Obviously, the superimposed settling strokes cause such a pulsating lifting motion of the water that a stratification according to density of the material fed in is obtained even if only coal mud is involved. In any case, the effect of the superimposition of settling strokes is that the specifically heavier refuse material accumulates on the settling screen below and the specifically lighter coal accumulates above, and that the phenomenon of equal settling in the range of finest grain is absent.

The following are further substantially advantageous features of the invention. The invention provides, and this is of particular importance, that for superimposing settling strokes having a higher frequency, the second control valve operates with shorter opening and closing times than the first control valve. Thereby, a completely satisfactory separation effect is obtained even with a material of finest grain. The higher frequency of the superimposed settling strokes obviously ensures that even with the finest grain size, the particles of the feed remain at their unequal dropping speeds. This sorting effect with the finest material is further supported by the inventive provision that the two air inlet connections with their control valves are connected to different air tanks or air tank compartments having different pressures, so that unequally strong blasts and, thereby, unequally strong settling strokes, are produced. The result obtained is that the rising and dropping motion of the water oscillating against the jig screen is influenced in a largely differentiated manner.

In this respect, the invention teaches that the opening and closing times of the first control valve are adjustable, in a well-known manner, to 20 to 50 settling strokes per minute, and the opening and closing times of the second control valve is adjustable between 150 to 250 settling strokes per minute.

In accordance with the invention, the first air inlet connection is connected to an air tank pressurized to an excess pressure of 0.1 to 0.3 bar, in a manner known per se, while the second air inlet connection is connected to an air tank which is pressurized to an excess pressure of 0.3 to 0.5 bar. Experience has shown that with such a settling stroke combination, an optimum separating effect is obtained, particularly in the treatment of coal sludge. The control valves in the air inlet connections may be associated with shutoff devices, in order to be able to put all of the control valves, with the exception of one, out of operation and still ensure the function of the respective settling chambers. For each settling chamber, of course, more than two air inlet connections may be provided having their own control valves.

In principle, it is not necessary to provide at least two air outlet connections, each with a control valve of its own, for each air conduit of a settling chamber, but advantageously, each air conduit will be equipped with two or more air outlet connections having their own control valves. The opening and closing times of these control valves will then be adjusted to the working cycle of the control valves which are provided in the air inlet connections. A further possibility is to equip the air inlet connections with control valves having a double function, so that during each settling stroke cycle, in the first phase, these valves serve the purpose of admitting the air from the air tank into the air chambers and, in the second phase, they serve the purpose of evacuating the working air from the air chambers to the outside.

The advantages obtained with the invention are substantially that a settling machine is obtained which is suitable for upgrading coal or similar minerals even in the finest grain size range of the material to be processed, i.e., in the range of 0.5 to 0 mm, and still ensures an optimum discrimination. At the same time, the construction remains relatively simple, since for the purpose of producing the superimposed settling strokes with the application of higher pressure, a minimum of additional equipment is needed. This also results in a construction which is efficient in operation.

Accordingly, it is an object of the invention to provide an improved method of upgrading material, such as coal, using a settling chamber having a jig screen arranged at the water level of the settling chamber and which comprises subjecting the water level to a controlled pulsating pressure from two different pressure sources after the material to be upgraded is placed on the jig screen so as to subject the material to lifting motions of the pulsating liquid, and with the small grain size material being settled into the settling tank and the coarser materials being delivered off of the end of the jig screen.

A further object of the invention is to provide a settling device which includes a settling chamber having a jig screen over the water level and an air chamber connected to the chamber having a plurality of connections to separate pressure sources with controls for each so that pulsating air pressures may be applied to the liquid level to act upon the material which is arranged on the jig screen for settling the material.

Another object of the invention is to provide a settling device which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
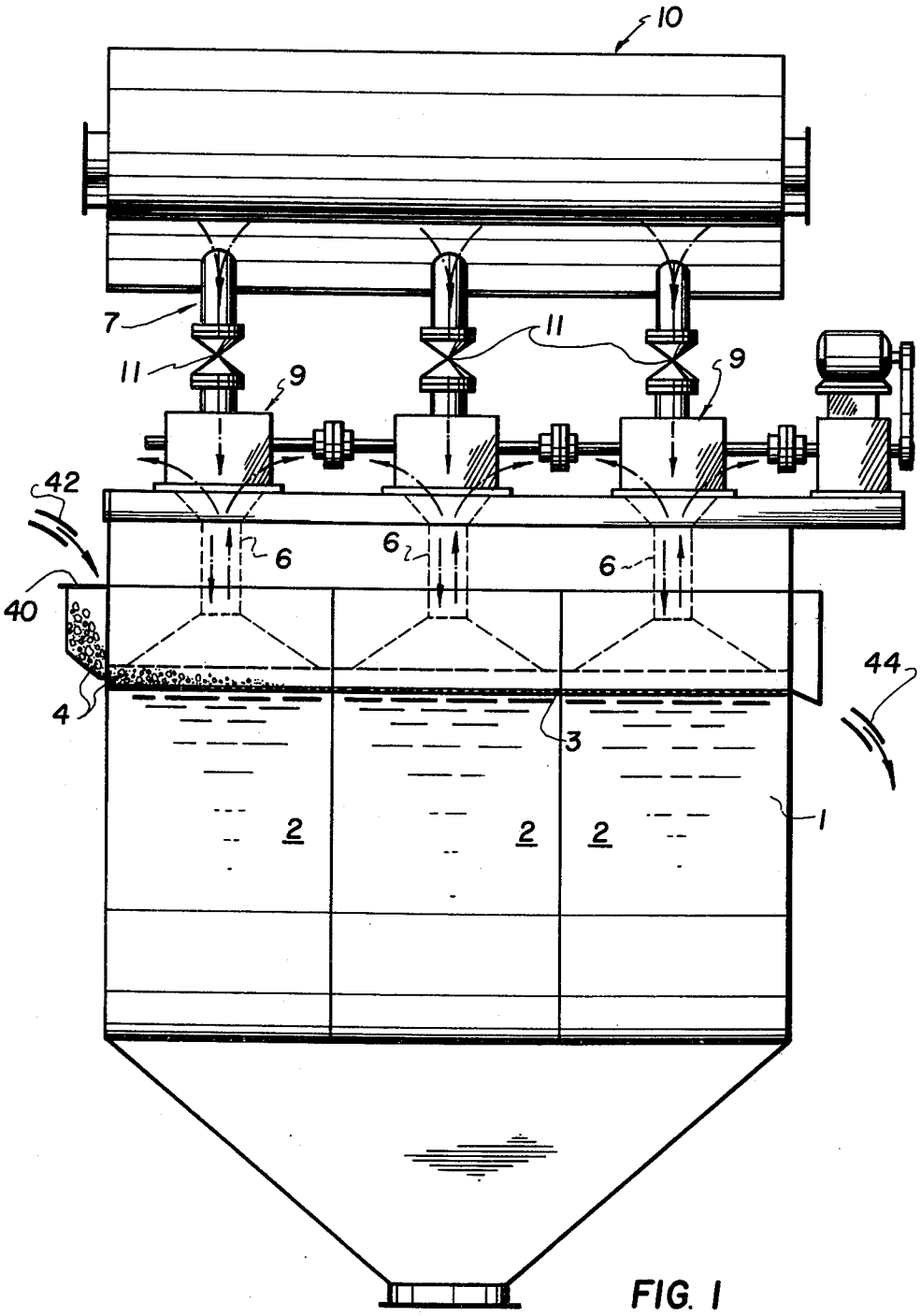
FIG. 1 is a diagrammatical side elevational view of a settling machine constructed in accordance with the invention.
Figure 2:
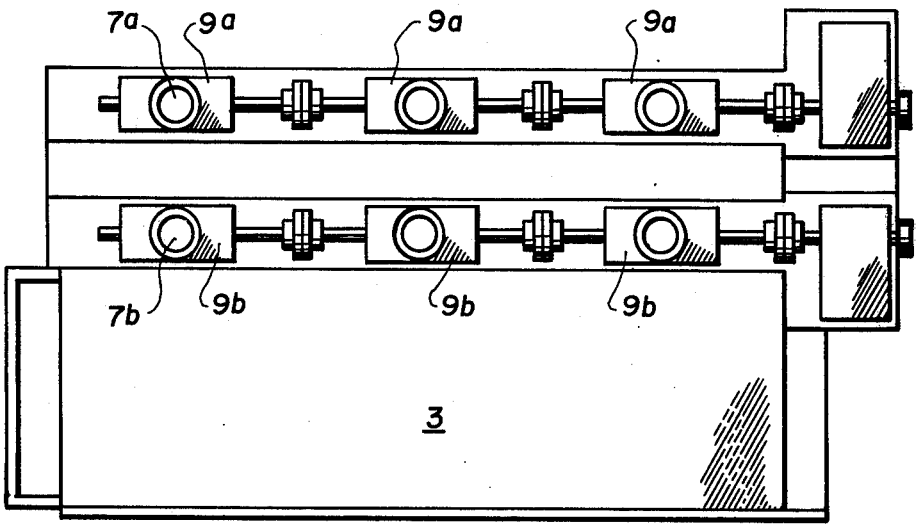
FIG. 2 is a top plan view of the device shown in FIG. 1.
Figure 3:
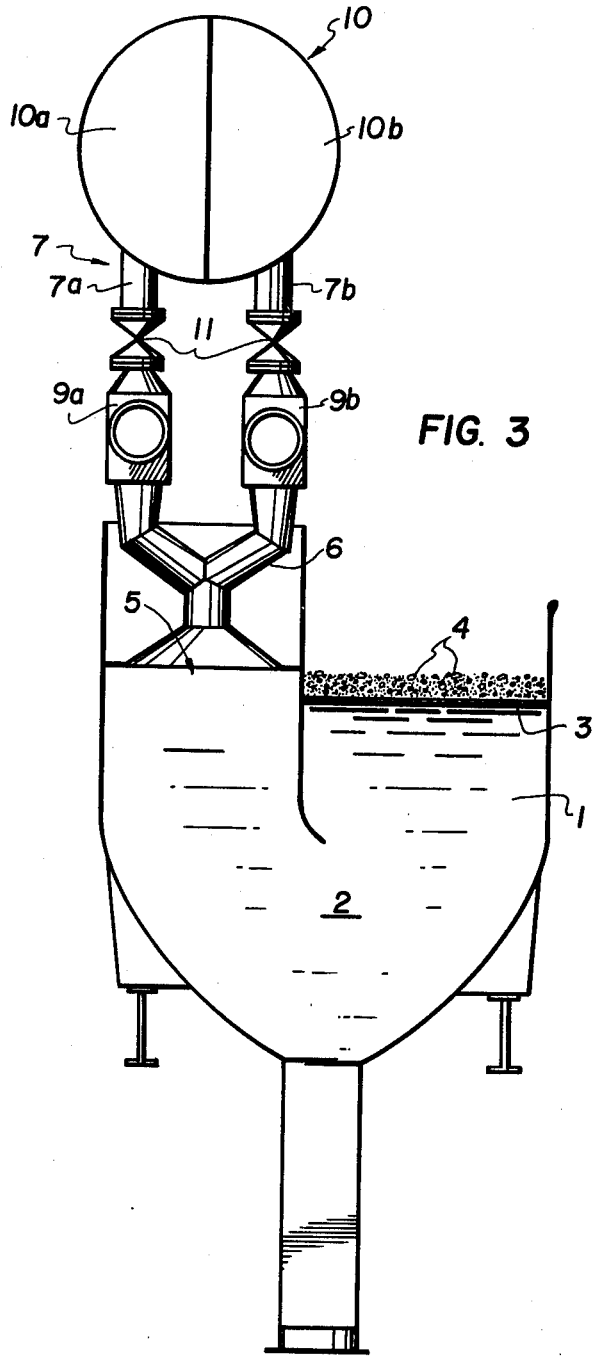
FIG. 3 is a front view of the device shown in FIG. 1.

Referring to the drawings in particular, the invention embodied therein, comprises a method and apparatus for settling materials, such as coal 4, which is fed in through an inlet 40 of the device in the direction of the arrow 42 over a jig screen 3. The settling machine serves the purpose of upgrading coal or similar minerals. The machine comprises one or more settling chambers 2 which are filled with water 1 and accommodate a jig screen 3 for the material 4 to be settled. In addition, one or more air chambers 5 are provided laterally of the jig screen 3, which can be pressurized with pulsating compressed air and which are connected through air conduits 6 with air inlet connections, generally designated 7.

Control valves, generally designated 9 for the admission and discharging of air to an air tank 10 are provided in the inlet connections 7. Each air conduit 6 is provided with at least two connecting air inlet lines **7*a*, 7*b*, comprising the inlet connections 7 having each its own control valve 9*a*, 9*b* of which the second valve 9*b* controls a superimposed settling stroke. For the superimposing of settling strokes of higher frequency, second control valve 9*b* operates with shorter opening and closing times than the first control valve 9*a***.

The two air inlet connections **7*a*, 7*b* with their control valves 9 are connected to different air tanks or air tank compartments 10*a* and 10*b* having different pressures. The opening and closing times of first control valve 9*a* are adjustable to a setting of between 20 to 50 settling strokes per minute, while the opening and closing times of second control valve 9*b* are adjustable to a setting ob between 150 to 250 settling strokes per minute. First air inlet connection 7*a* is connected to an air tank 10*a* which is pressurized to from 0.1 to 0.3 bar of excess pressure, and second air inlet connection 7*b* is connected to an air tank pressurized to from 0.3 to 0.5 bar of excess pressure. Control valves 9 in air inlet connections 7 may be associated with shutoff devices 11. Each air conduit 6** may be provided with at least two air outlet connections also (not shown) each having its own control valve.

The material to be settled is fed in through an inlet 40 in the direction of arrow 42 and the coarser material is fed out through an outlet in the direction of arrow 44.

While a specific embodiment of the invention has been shown and described in detail to illustrate the application of the principles of the invention, it will be understood that the invention may be embodied otherwise without departing from such principles.

What is claimed is:

1. A settling machine for upgrading materials, particularly for upgrading coal, comprising at least one settling chamber filled with water, a jig screen for the material to be upgraded overlying a part of said chamber, means for feeding the material to be upgraded onto said jig screen, at least one air chamber extending laterally of and below said jig screen for communicating pulsations therein to the water surface level in the settling chamber, a plurality of compressed air tanks, an air conduit for each air tank connected between each air tank and said air chamber, a pulsation control valve for each conduit for superimposing pulsations of different frequencies on the settling liquid to effect a superimposed settling stroke.

2. A settling device for upgrading materials, particularly for upgrading coal, comprising at least one settling chamber filled with water, a jig screen covering at least a portion of said chamber substantially at the water level in said chamber, means for feeding the material to be upgraded onto said jig screen, a plurality of sources of compressed air at different predetermined pressures, and pulsation control means connected between said sources and said settling chamber for superimposing pulsations of the air under diverse pressures at diverse frequencies on the water level of said chambers.

3. A settling device, according to claim 2, wherein said pulsation control means includes first and second control lines connected to said air chamber, each having a respective first and second pulsation control valves, said second pulsation control valve operating with a shorter opening and closing time than said first control valve.

4. A settling device, according to claim 3, including a separate pressure tank connected to each of said control lines.

5. A settling device, according to claim 3, wherein the opening and closing times of the first pulsation control valve is adjustable to from 20 to 50 settling strokes per minute and the opening and closing times of said second pulsation control valve is adjustable to from 150 to 250 settling strokes per minute.

6. A settling device, according to claim 5, including a shutoff control device in each of said control lines.

7. A settling device, according to claim 2, wherein said plurality of sources of compressed air comprises at least two air tanks of different pressure, one of which is pressurized to an excess pressure of from 0.1 to 0.3 bar and the second of which is provided with an air pressure of an excess pressure of from 0.3 to 0.5 bar.

8. A settling device, according to claim 2, wherein said plurality of sources of compressed air comprises at least two compressed air tanks at separate pressures, at least a control line for each tank connected between each tank and the associated air chamber and each line having its own pulsation control valve.

* * * * *